US007578948B2

(12) United States Patent
Minafuji et al.

(10) Patent No.: US 7,578,948 B2
(45) Date of Patent: Aug. 25, 2009

(54) METHOD OF PRODUCING LOW CONCENTRATION AQUEOUS SOLUTION OF AGENT FOR PROCESSING SYNTHETIC FIBERS

(75) Inventors: Makoto Minafuji, Gamagori (JP); Shinji Sahara, Gamagori (JP); Kuniyasu Inagaki, Gamagori (JP)

(73) Assignee: Takemoto Yushi Kabushiki Kaisha, Aichi (JP)

( * ) Notice: Subject to any disclaimer, the term of this patent is extended or adjusted under 35 U.S.C. 154(b) by 1016 days.

(21) Appl. No.: 10/856,368

(22) Filed: May 28, 2004

(65) Prior Publication Data

US 2005/0029486 A1 Feb. 10, 2005

(30) Foreign Application Priority Data

Aug. 7, 2003 (JP) ..... 2003-288493

(51) Int. Cl.
*D06M 13/224* (2006.01)

(52) U.S. Cl. ..... 252/8.81; 427/212

(58) Field of Classification Search ..... 427/212, 427/9; 252/8.81
See application file for complete search history.

(56) References Cited

U.S. PATENT DOCUMENTS 5,545,481 A 8/1996 Harrington
2002/0104168 A1 * 8/2002 Kita et al. ..... 8/115.51

FOREIGN PATENT DOCUMENTS

JP 05186484 A * 7/1993
WO WO96/10599 11/1996

* cited by examiner

*Primary Examiner*—Roberts Culbert
(74) *Attorney, Agent, or Firm*—Weaver Austin Villeneuve & Sampson

(57) ABSTRACT

A low concentration aqueous solution of agent for processing synthetic fibers is produced by preparing acidic alkyl phosphate which is solid at room temperatures and gradually adding this prepared acidic alkyl phosphate with stirring to an aqueous solution containing potassium hydroxide in an amount for partially neutralizing this added acidic alkyl phosphate to obtain 0.1-10 weight % low concentration aqueous solution of agent for processing synthetic fibers containing potassium alkyl phosphate.

10 Claims, No Drawings

METHOD OF PRODUCING LOW CONCENTRATION AQUEOUS SOLUTION OF AGENT FOR PROCESSING SYNTHETIC FIBERS

Priority is claimed of Japanese Patent Application 2003-288493 filed Aug. 7, 2003.

BACKGROUND OF THE INVENTION

This invention relates to a method of processing low concentration aqueous solution of agent for processing synthetic fibers containing potassium alkyl phosphate which is solid at room temperature and being stable over a long period of time such that the agent can be attached to synthetic fibers as desired for a long time.

At spinning and fabrication factories of synthetic fibers, agents for processing synthetic fibers containing potassium alkyl phosphate, and normally potassium alkyl phosphate having alkyl group with 12-22 carbons atoms, are frequently applied to synthetic fibers. Generally, such an agent is produced as a high concentration aqueous solution or a paste with concentration of about 20-60 weight % at a chemical factory different and apart from the production or fabrication factories of synthetic fibers, and a low concentration aqueous solution of about 0.1-10 weight % is prepared after it is transported to a spinning or fabrication factory to be applied to synthetic fibers, as disclosed, for example, in Japanese Patent Publication Tokkai 2002-20971.

It is usually several months to a half year from when such a high concentration aqueous solution or a paste of agent for processing synthetic fibers is produced until it comes to be actually used after being stored and transported. Since 40-80 weight % of such a high concentration aqueous solution and a paste is water, it means that a large portion of the cost of their storage and transportation is for water. Because of their high water content, furthermore, high concentration aqueous solutions and pastes of such an agent tend to become degraded while in stage or being transported, and floating substances and sediments are frequently generated in low concentration aqueous solutions prepared therefrom. Even if such a low concentration aqueous solution is applied to synthetic fibers, it is not always possible to provide the synthetic fibers with desired characteristics.

SUMMARY OF THE INVENTION

It is therefore an object of this invention to provide a method of producing a low concentration aqueous solution of agent for processing synthetic fibers having potassium alkyl phosphate which is solid at room temperatures and such a solution that can be produced inexpensively as an agent to be attached to synthetic fibers at their spinning and fabrication factories and has improved stability without generating floating substances or sediments. It is also an object of this invention to provide a low concentration aqueous solution produced by such a method and a method of processing synthetic fibers by using such an agent.

The inventors herein have discovered, as a result of their studies in view of these objects, that an appropriate method to obtain a low concentration aqueous solution for processing synthetic fibers containing potassium alkyl phosphate which is solid at room temperatures is to gradually add with stirring acidic alkyl phosphate which is solid at room temperatures to an aqueous solution containing potassium hydroxide in an amount for partially neutralizing this acidic alkyl phosphate so as to obtain 0.1-10 weight % low concentration aqueous solution of agent for processing synthetic fibers having potassium alkyl phosphate which is solid at room temperatures.

DETAILED DESCRIPTION OF THE INVENTION

This invention relates to a method of producing a low concentration aqueous solution for processing synthetic fibers having potassium alkyl phosphate which is solid at room temperatures by gradually adding with stirring acidic alkyl phosphate which is solid at room temperatures to an aqueous solution containing potassium hydroxide in an amount for partially neutralizing this acidic alkyl phosphate so as to obtain 0.1-10 weight % low concentration aqueous solution of agent for processing synthetic fibers having potassium alkyl phosphate which is solid at room temperatures.

This invention also relates to a low concentration aqueous solution of agent for processing synthetic fibers produced by such a method.

The invention further relates to a method of processing synthetic fibers by attaching such a solution according to this invention to synthetic fibers at a rate of 0.1-1 weight % with respect to the synthetic fibers.

A method of this invention for producing a low concentration aqueous solution of agent for processing synthetic fibers (hereinafter "the production method of this invention") is explained first. According to this invention, such a low concentration (0.1-10 weight %) aqueous solution of an agent for processing synthetic fibers is obtained by gradually adding acidic alkyl phosphate which is solid at room temperatures with stirring into an aqueous solution containing potassium hydroxide in an amount for partially neutralizing this acidic alkyl phosphate.

The acidic alkyl phosphate to be partially neutralized according to this invention is solid at room temperatures. For this purpose, those of acidic alkyl phosphate having alkyl group with 12-22 carbon atoms are usually used but those having alkyl group with 16-18 carbon atoms are preferable. Examples of such acidic alkyl phosphate include acidic dodecyl phosphate, acidic tridecyl phosphate, acidic tetradecyl phosphate, acidic pentadecyl phosphate, acidic hexadecyl phosphate, acidic heptadecyl phosphate, acidic octadecyl phosphate, acidic nonadecyl phosphate, acidic eicosyl phosphate and acidic docosyl phosphate. These acidic alkyl phosphates include individual monoesters, individual diesters and mixtures of monoesters and diesters, and diesters include both those having the same alkyl groups (symmetric diesters) and those having different alkyl groups (non-symmetric diesters). These acidic alkyl phosphates can be synthesized by any of known prior art methods such as by a phosphation reaction between phosphoric anhydride and saturated aliphatic alcohol with 12-22 carbon atoms.

Acidic alkyl phosphates with acid value 100-300 are preferred and those with acid value 160-210 are even more preferred for the partial neutralization according to the method of this invention. Those with phosphation ratio 0.6-1 are preferred and those with phosphation ratio 0.65-0.90 are even more preferred. In the above, the phosphation ratio is the calculated value showing how many moles of phosphorus is combined per one mole of the aliphatic alcohol that has been used.

The invention does not impose any particular limitation as to the form of the acidic alkyl phosphate to be used for the partial neutralization but it is preferable to be in the form of flakes or powders and it is particularly preferable to be in the form of flakes with thickness 0.5-1.5 mm or powders with particle diameters less than 0.7 mm.

As for the amount of potassium hydroxide that is used for partially neutralizing acidic alkyl phosphate in solid form at room temperatures, it is preferable that 70-99% of the acid value of the acidic alkyl phosphate can be neutralized and more preferably so as to neutralize 70-95% of the acid value of the acidic alkyl phosphate.

As explained above, acidic alkyl phosphate in solid form at room temperatures is added to an aqueous solution containing potassium hydroxide in an amount for partially neutralizing the acidic alkyl phosphate gradually with stirring so as to generate potassium alkyl phosphate in solid form at room temperatures and a low concentration (0.1-10 weight %) aqueous solution of agent for processing synthetic fibers containing it. Such a low concentration aqueous solution may contain nothing but potassium alkyl phosphate but may also have some other constituents. Examples of such other constituents include Component A defined as one or more selected from the group consisting of alkylene oxide adducts of aliphatic monohydric alcohol, alkylene oxide adducts of substituted aromatic monohydric alcohol, alkylene oxide adducts of aliphatic amine, organic sulfonates, higher fatty acid salts, salts of acidic alkyl phosphates which are liquid at room temperatures, alkenyl phosphate salts, alkyl(poly)oxyalkylene phosphate salts and alkenyl(poly)oxyalkylene phosphate salts, and Component B defined as one or more selected from the group consisting of alkylene oxide addusts of aliphatic amide, ester of polyoxyalkylene polyhydric alcohol and fatty acids, alkylene oxide adducts of aliphatic acid, aliphatic partial esters of polyhydric alcohol, organic sulfuric acid salts, amphoteric surfactants, cationic surfactants, synthetic ester compounds, polyether compounds, polyether (poly)ester compounds, vegetable oils, animal oils, waxes, mineral oils, silicone compounds, aliphatic hydroxy compounds, lower aliphatic acids and salts of lower aliphatic acid.

Known kinds of alkylene oxide adducts of aliphatic monohydric alcohol may be used as Component A but alkylene oxide adducts with 2 or 3 carbon atoms of aliphatic monohydric alcohol with 8-22 carbon atoms are preferred. Examples of aliphatic monohydric alcohol with 8-22 carbon atoms include octyl alcohol, nonyl alcohol, decyl alcohol, undecyl alcohol, dodecyl alcohol, tridecyl alcohol, tetradecyl alcohol, pentadecyl alcohol, hexadecyl alcohol, heptadecyl alcohol, octadecyl alcohol, 2-ethylhexyl alcohol, 3,5,5-trimethylhexyl alcohol, octenyl alcohol, hexadecenyl alcohol and octadecenyl alcohol. Examples of alkylene oxide with 2 or 3 carbon atoms include ethylene oxide and propylene oxide. The amount of alkylene oxide to be added is preferably 1-40 moles and the mode of connection of alkylene oxide may be random, block or random-block connections.

Known kinds of alkylene oxide adducts of substituted aromatic monohydric alcohol may be used as Component A but alkylene oxide adducts with 2 or 3 carbon atoms of substituted aromatic monohydric alcohols substituted with alkyl group with 8-18 carbon atoms are preferable. Examples of substituted aromatic monohydric alcohol substituted with alkyl group with 8-18 carbon atoms include octyl phenol, nonyl phenol and tridecyl phenol. Examples of alkylene oxide with 2 or 3 carbon atoms include ethylene oxide and propylene oxide. The amount of alkylene oxide to be added is preferably 1-20 moles and the mode of connection of alkylene oxide is the same as for the alkylene oxide adducts of aliphatic monohydric alcohol described above.

Known kinds of alkylene oxide adducts of aliphatic amine may be used as Component A but alkylene oxide adducts with 2 or 3 carbon atoms of aliphatic amine with 8-18 carbon atoms are preferable. Examples of aliphatic amine with 8-18 carbon atoms include (1) aliphatic primary amines with 8-18 carbon atoms such as octyl amine, nonyl amine, lauryl amine, myristyl amine, cetyl amine and stearyl amine; and (2) aliphatic secondary amines with 8-18 carbon atoms such as dioctyl amine, dinonyl amine, dilauryl amine, dimyristyl amine, dicetyl amine and distearyl amine. Examples of alkylene oxide with 2 or 3 carbon atoms include ethylene oxide and propylene oxide. The amount of alkylene oxide to be added is preferably 1-20 moles and the mode of connection of alkylene oxide is the same as for the alkylene oxide adducts of aliphatic monohydric alcohol described above.

Known kinds of alkylene oxide adducts of organic sulfonic acid salt may be used as Component A but organic sulfonic acid salts with 6-22 carbon atoms are preferred and alkali metal salts, amine salts and phosphonium salts of organic sulfonic acid with 6-22 carbon atoms are particularly preferred. Examples of organic sulfonic acid with 6-22 carbon atoms include (1) alkyl sulfonic acids such as decyl sulfonic acid, dodecyl sulfonic acid, isotridodecyl sulfonic acid, tetradecyl sulfonic acid and hexadecyl sulfonic acid; (2) alkylaryl sulfonic acids such as butyl benzene sulfonic acid, dodecyl benzene sulfonic acid, octadecyl benzene sulfonic acid and dibutyl naphthalene sulfonic acid; and (3) ester sulfonic acids such as dioctyl sulfosuccinate, dibutyl sulfosuccinate and dodecyl sulfoacetate, and nonylphenoxy polyethyleneglycol sulfoacetate. Examples of alkali metal for forming alkali metal salts of these organic sulfonic acids include sodium, potassium and lithium. Examples of amine for forming amine salts of the organic sulfonic acids include (1) aliphatic amines such as methylamine, dimethylamine, trimethylamine, ethylamine, diethylamine, triethylamine, butylamine, dibutylamine, tributylamine, and octylamine; (2) aromatic amines and their heterocyclic amines such as aniline, pyridine, morpholine, piperazine, and their derivatives; and (3) alkanolamines such as monoethanolamine, diethanolamine, triethanolamine, isopropanolamine, diisopropanolamine, triisopropanolamine, butyl diethanolamine, octyl diethanolamine and lauryl diethanolamine. Examples of organic phosphonium group forming phosphonium salts of organic sulfonic acid include (1) organic phosphonium groups of which organic groups connected to a phosphorus atom are all aliphatic hydrocarbon group with 1-5 carbon atoms or hydroxyalkyl group with 2-3 carbon atoms such as tetramethyl phosphonium, triethylmethyl phosphonium, tripropylethyl phosphonium, tetrabutyl phosphonium, bis(2-hydroxyethyl)-dimethyl phosphonium, bis(3-hydroxypropyl)-dimethyl phosphonium, and tris(2-hydroxyethyl)-methyl phosphonium; (2) organic phosphonium groups of which any one of organic groups connected to a phosphorus atom is aliphatic hydrocarbon group with 6-18 carbon atoms and the remain three are aliphatic hydrocarbon group with 1-5 carbon atoms or hydroxyalkyl group with 2-3 carbon atoms such as triethyl octyl phosphonium, trimethyl lauryl phosphonium, trimethyl stearyl phosphonium and tris(2-hydroxyethyl)-octyl phosphonium; and (3) organic phosphonium groups of which any two or more of organic groups connected to a phosphorus atom are aliphatic hydrocarbon group with 6-18 carbon atoms and the remaining two or less are aliphatic hydrocarbon group with 1-5 carbon atoms or hydroxyalkyl group with 2-3 carbon atoms such as dimethyl-dioctyl phosphonium, diethyl-dilauryl phosphonium, bis(2-hydroxyethyl)-distearyl phosphonium and trioctyl-methyl phosphonium.

Known kinds of higher fatty acid salt may be used as Component A but alkali metal salts and amine salts of aliphatic monocarboxylic acid with 8-22 carbon atoms are preferred. Examples of aliphatic monocarboxylic acid with 8-22 carbon atoms include (1) saturated aliphatic monocarboxylic acids such as caproic acid, caprylic acid, capric acid, undecanoic acid, lauric acid, tridecanoic acid, myristic acid, pentadecanoic acid, palmitic acid, stearic acid, nonadecanoic acid, arachidic acid and behenic acid; (2) aliphatic monoene monocarboxylic acids such as linderic acid, palmitoleic acid, oleic acid, elaidic acid and vaccenic acid; and (3) aliphatic unconjugated polyene monocarboxylic acids such as linoleic acid, linolenic acid and arachidonic acid. Alkali metal and amine salts for forming salts of such aliphatic monocarboxylic acids are the same as described above regarding organic sulfonates.

Known kinds of salts of acidic alkyl phosphates which are liquid at room temperatures may be used as Component A but alkali metal salts of acidic alkyl phosphate having alkyl group with 4-11 carbon atoms are preferred. Examples of such alkali metal salts include alkali salts of butyl phosphate, pentyl phosphate, hexyl phosphate, heptyl phosphate, octyl phosphate, isooctyl phosphate, 2-ethylhexyl phosphate and decyl phosphate. These alkali metal salts of acidic alkyl phosphates include individual monoesters, individual diesters and mixtures of monoesters and diesters, and diesters include both those having the same alkyl groups (symmetric diesters) and those having different alkyl groups (non-symmetric diesters).

Known kinds of salt of alkenyl phosphate may be used as Component A but alkaline metal salts of alkenyl phosphates having alkenyl group with 14-18 carbon atoms are preferred. Examples thereof include alkaline metal salts of tetradecenyl phosphates, alkaline metal salts of hexadecenyl phosphates and alkaline metal salts of octadecenyl phosphates. These alkaline metal salts of alkenyl phosphates include individual monoesters, individual diesters and mixtures of monoesters and diesters, and diesters include both those having the same alkenyl groups (symmetric diesters) and those having different alkenyl groups (non-symmetric diesters).

Known kinds of salt of alkyl(poly)oxyalkylene phosphate and salt of alkenyl(poly)oxyalkylene phosphate may be used as Component A but alkaline salts of alkyl(poly)oxyalkylene phosphates having alkyl group with 4-22 carbon atoms and having 1-10 oxyalkylene units forming (poly)oxyalkylene group are preferred. Examples thereof include alkaline metal salts of butyl(poly)oxyalkylene phosphates, alkaline metal salts of pentyl(poly)oxyalkylene phosphates, alkaline metal salts of hexyl(poly)oxyalkylene phosphates, alkaline metal salts of heptyl(poly)oxyalkylene phosphates, alkaline metal salts of octyl(poly)oxyalkylene phosphates, alkaline metal salts of isooctyl(poly)oxyalkylene phosphates, alkaline metal salts of 2-ethylhexyl(poly)oxyalkylene phosphates, alkaline metal salts of decyl(poly)oxyalkylene phosphates, alkaline metal salts of lauryl(poly)oxyalkylene phosphates, alkaline metal salts of tridecyl(poly)oxyalkylene phosphates, alkaline metal salts of myristyl(poly)oxyalkylene phosphates, alkaline metal salts of cetyl(poly)oxyalkylene phosphates, alkaline metal salts of stearyl(poly)oxyalkylene phosphates, alkaline metal salts of eicosyl(poly)oxyalkylene phosphates, alkaline metal salts of behenyl(poly)oxyalkylene phosphates, alkaline metal salts of tetradecenyl(poly)oxyalkylene phosphates, alkaline metal salts of hexadecenyl(poly)oxyalkylene phosphates, alkaline metal salts of octadecenyl(poly)oxyalkylene phosphates and alkaline metal salts of docosenyl (poly)oxyalkylene phosphates. Examples of (poly)oxyalkylene group of such alkaline metal salts of alkyl(poly) oxyalkylene phosphates include (poly)oxyethylene group, (poly)oxypropylene group and (poly)oxyethylene oxypropylene group. These alkaline metal salts of alkyl(poly)oxyalkylene phosphates include individual monoesters, individual diesters and mixtures of monoesters and diesters, and diesters include both those having the same alkyl groups (symmetric diesters) and those having different alkyl groups (non-symmetric diesters).

Known kinds of alkylene oxide adduct of aliphatic amide may be used as Component B but adducts of aliphatic amide with 8-22 carbon atoms with alkylene oxide with 2 or 3 carbon atoms are preferred. Examples of aliphatic amide with 8-22 carbon atoms include octane amide, nonane amide, decane amide, undecane amide, dodecane amide, tridecane amide, tetradecane amide, hexadecane amide and octadecane amide. Examples of alkylene oxide with 2 or 3 carbon atoms are the same as those described above regarding alkylene oxide adducts of aliphatic monohydric alcohol as Component A.

Known kinds of ester of polyoxyalkylene polyhydric alcohol and fatty acid may be used as Component B but (1) adducts of partial ester of trihydric-hexahydric alcohol and aliphatic monocarboxylic acid with alkylene oxide with 2 or 3 carbon atoms, (2) partial or complete esters of trihydric-hexahydric alcohol added with alkylene oxide with 2 or 3 carbon atoms and aliphatic monocarboxylic acid, and (3) adduct of ester of trihydric-hexahydric alcohol and hydroxy aliphatic monocarboxylic acid with alkylene oxide with 2 or 3 carbon atoms are preferred. Examples of trihydric-hexahydric alcohol include glycerol, diglycerol, trimethyrol propane, trimethyrol ethane, pentaerythritol, sorbitol and sorbitan. Examples of aliphatic monocarboxylic acid include (1) saturated aliphatic monocarboxylic acids such as acetic acid, butyric acid, caproic acid, caprylic acid, capric acid, undecanoic acid, lauric acid, tridecanoic acid, myristic acid, pentadecanoic acid, palmitic acid, stearic acid, nonadecanoic acid, arachidic acid, behenic acid, cerotic acid, montanic acid and melissic acid; (2) aliphatic monoene monocarboxylic acids such as linderic acid, palmitoleic acid, oleic acid, elaidic acid and vaccenic acid; and (3) aliphatic unconjugated polyene monocarboxylic acids such as linoleic acid, linolenic acid, and arachidonic acid. Examples of hydroxy aliphatic monocarboxylic acid include lactic acid, tartaric acid and hydroxy stearic acid. Alkylene oxides with 2 or 3 carbon atoms are the same as described above regarding alkylene oxide adducts of aliphatic monohydric alcohols as Component A.

Known kinds of alkylene oxide adducts of aliphatic acid may be used as Component B such as monoesters and diesters obtained as adducts of aliphatic acid and alkylene oxide with 2 or 3 carbon atoms. Aliphatic acids are the same as described above regarding ester of polyoxyalkylene polyhydric alcohol and fatty acid and alkylene oxides with 2 or 3 carbon atoms are the same as described above regarding alkylene oxide adducts of aliphatic monohydric alcohol as Component A.

Known kinds of aliphatic partial esters of polyhydric alcohol and fatty acid may be used as Component B but those derived from tetrahydric-hexahydric polyols and aliphatic monocarboxylic acid are preferred. Examples of such tetrahydric-hexahydric polyols include (1) polyhydric alcohols such as pentaerythritol, sorbitol and glucose; (2) polyhydroxy cyclic ethers obtained by dehydration of sorbitol such as sorbitan and sorbide; (3) (poly)ether tetraols such as diglycerol and ethyleneglycol diglycerylether; (4) (poly)ether pentaols such as triglycerol and trimethylol propane diglycerylether; and (5) (poly)ether hexaols such as tetraglycerol and dipentaerythritol. Examples of aliphatic monocarboxylic acid include those with 8-22 carbon atoms, and more in detail, (1) saturated aliphatic monocarboxylic acids such as caproic acid, caprylic acid, capric acid, undecanoic acid, lauric acid, tridecanoic acid, myristic acid, pentadecanoic acid, palmitic acid, stearic acid, nonadecanoic acid, arachidic acid and behenic acid; (2) aliphatic monoene monocarboxylic acids such as linderic acid, palmitoleic acid, oleic acid, elaidic acid and vaccenic acid; and (3) aliphatic unconjugated polyene monocarboxylic acids such as linoleic acid, linolenic acid and arachidonic acid. Among aliphatic partial esters of polyhydric alcohols and fatty acids, those having 3 or 4 free hydroxy groups and one or two aliphatic monocarboxylic ester groups in the molecule are preferred. Examples thereof include sorbitan monoesters, diglycerol monoesters, triglycerol mono and diesters and tetraglycerol diesters.

Known kinds of organic sulfuric acid salt may be used as Component B such as (1) alkaline metal salts of alkyl sulfate such as sodium decyl sulfate, sodium dodecyl sulfate, lithium tetradecyl sulfate and potassium hexadecyl sulfate; and (2) alkaline metal salts of sulfates of natural fats and oils such as sulfated beef tallow oil and sulfated castor oil, but sodium dodecyl sulfate is particularly preferred.

Known kinds of amphoteric surfactant may be used as Component B such as dimethyloctylammonioacetate, decyldimethylammonioacetate, hexadecyldimethyl-ammonioacetate, octadecyldimethylammonioacetate, nonadecyldimethylammonioacetate and octadecenyldimethylammonioacetate.

Known kinds of cationic surfactant may be used as Component B but quaternary ammonium salt type cationic surfactants are preferred. Examples of quaternary ammonium salt type cationic surfactant include tetramethyl ammonium salt, triethylmethyl ammonium salt, tripropylethyl ammonium salt, tributylmethyl ammonium salt, tetrabutyl ammonium salt, triisooctylethyl ammonium salt, trimethyloctyl ammonium salt, dilauryldimethyl ammonium salt, trimethylstearyl ammonium salt, dibutenyldiethyl ammonium salt, dimethyldioleyl ammonium salt, trimethyloleyl ammonium salt, tributylhydroxyethyl ammonium salt, di(hydroxyethyl)dipropyl ammonium salt, tri(hydroxyethyl)octyl ammonium salt and tri(hydroxypropyl)methyl ammonium salt.

Known kinds of synthetic ester compound may be used as Component B but aliphatic esters with 17-60 carbon atoms are preferred. Aliphatic esters with 17-60 carbon atoms include many kinds obtained from aliphatic hydroxy compounds and aliphatic acids such that the total number of carbon atoms of the hydrocarbon group of the aliphatic hydroxy compound and the hydrocarbon group of the aliphatic acid is 17-60 but those with a total of 22-36 carbon atoms are preferred. Examples of such aliphatic hydroxy compound include (1) aliphatic monohydroxy compounds such as methyl alcohol, ethyl alcohol, butyl alcohol, octyl alcohol, 2-ethylhexyl alcohol, lauryl alcohol, palmityl alcohol, palmitoleyl alcohol, stearyl alcohol, isostearyl alcohol, oleyl alcohol and behenyl alcohol; and (2) aliphatic polyhydroxy compounds such as ethyleneglycol, propyleneglycol, butane diol, hexane diol, glycerol, trimethylol propane, sorbitol and pentaerythritol. Examples of aliphatic acid include (1) saturated aliphatic monocarboxylic acids such as acetic acid, butyric acid, caproic acid, caprylic acid, capric acid, undecanoic acid, lauric acid, tridecanoic acid, myristic acid, pentadecanoic acid, palmitic acid, stearic acid, nonadecanoic acid, arachidic acid, behenic acid, cerotic acid, montanic acid and melissic acid; (2) aliphatic monoene monocarboxylic acids such as linderic acid, palmitoleic acid, oleic acid, elaidic acid and vaccenic acid; (3) aliphatic unconjugated polyene monocarboxylic acids such as linoleic acid, linolenic acid, and arachidonic acid; and (4) aliphatic dicarboxylic acids such as succinic acid, glutaric acid, adipic acid, pimelic acid, suberic acid, azelaic acid and sebacic acid. There are many kinds of aliphatic esters obtainable from such aliphatic hydroxy compounds and aliphatic acids but lauryl oleate, octyl stearate, glycerol tri(12-hydroxy stearate), sorbitan tetraoleate and dicetyl adipate are preferred.

Known kinds of polyether compounds may be used as Compound B but polyether(poly)ols having polyoxyalkylene group comprised of a total of 21-250 oxyalkylene units with 2-4 carbon atoms are preferred and those with average molecular value of 500-10000 are particularly preferred. Such polyether(poly)ols can be obtained by block or random addition of alkylene oxide with 2-4 carbon atoms to a monohydric-tetrahydric hydroxy compound. Examples of hydroxy compound to be used for the synthesis of polyether(poly)ols include (1) monohydric aliphatic hydroxy compounds with 1-40 carbon atoms such as methyl alcohol, butyl alcohol, pentyl alcohol, hexyl alcohol, heptyl alcohol, octyl alcohol, lauryl alcohol, stearyl alcohol, cetyl alcohol, isobutyl alcohol, 2-ethylhexyl alcohol, isododecyl alcohol, isohexadecyl alcohol, isostearyl alcohol, iso-tetracosanyl alcohol, 2-propyl alcohol, 12-eicosyl alcohol, vinyl alcohol, butenyl alcohol, hexadecenyl alcohol, oleyl alcohol, eicosenyl alcohol, 2-methyl-2-propylene-1-ol, 6-ethyl-2-undecene-1-ol, 2-octene-5-ol and 15-hexadecene-2-ol; (2) monohydric hydroxy compounds having aromatic ring such as phenol, propyl phenol, octyl phenol and tridecyl phenol; and (3) dihydric-tetrahydric aliphatic hydroxy compounds such as ethyleneglycol, propyleneglycol, butane diol, hexane diol, neopentylglycol, glycerol, trimethylol propane and pentaerythritol. Of the above, monohydric aliphatic hydroxy compounds with 3-16 carbon atoms are preferred and propyl alcohol, butyl alcohol, octyl alcohol and tetradecyl alcohol are particularly preferred.

Known kinds of polyether (poly)ester compounds may be used as Component B such as (1) polyether (poly)ester compounds having the structure of the aforementioned synthetic ester compound having a polyether part introduced; (2) polyether (poly)ester compounds having the structure of the aforementioned polyether compound having a (poly)ester part introduced; and (3) polyether polyester compounds obtained by condensation polymerization of polyhydric organic acid and polyether polyol but those with molecular value 1000-20000 are preferred.

Known kinds of vegetable and animal oils may be used as Component B. Those among them having glyceride having aliphatic residual group with 12-22 carbon atoms as principal component are preferred. Examples of such oils include (1) vegetable fats and oils such as linseed oil, tung oil, kaya oil, walnut oil, soyabean oil, poppy seed oil, sunflower seed oil, cottonseed oil, corn oil, sesame seed oil, rapeseed oil, rice bran oil, peanut oil, olive oil, tsubaki oil, castor oil, palm oil, palm kernel oil, coconut oil, cacao oil and japan wax; and (2) animal fats and oils such as beef tallow, lard and mutton tallow, but castor oil is particularly preferred.

Known kinds of waxes may be used as Component B but those with melting point in the range of 50-120° C. are preferred. Examples of such waxes include (1) ester compounds obtained from aliphatic monocarboxylic acid and aliphatic monohydric alcohol such as stearyl palmitate, stearyl stearate, behenyl behenate, stearyl behenate, cetyl palmitate, melissyl palmitate and cetyl cerotate; (2) glycerides such as glycerol monomyristate, glycerol monopalmitate, glycerol monostearate, glycerol dimyristate, glycerol dipalmitate, glycerol distearate, glycerol monostearate monopalmitate, glycerol tripalmitate, glycerol tristearate, glycerol monopalmitate distearate and glycerol dipalmitate monostearate; (3) natural waxes such as carnouba wax, beeswax and insect wax; (4) natural waxes such as montan wax of mineral type and paraffin wax of petroleum type; and (5) synthetic waxes synthesized from ethylene or the like such as polyethylene wax and polyethylene oxide wax. Of these, ester compounds obtained from aliphatic monohydric alcohol with 16-22 carbon atoms and aliphatic monocarboxylic acid with 16-22 carbon atoms and paraffin wax are preferred. Stearyl palmitate, stearyl stearate, stearyl behenate, behenyl behenate and paraffin waxes with melting point in the range of 50-60° C. are even more preferred.

Known kinds of mineral oil may be used as Component B but those with viscosity $2\times10^{-6}$-$2\times10^{-4}$ $m^2/s$ at 30° C. are preferred and those with viscosity $2\times10^{-6}$-$5\times10^{-5}$ $m^2/s$ at 30° are even more preferred. Examples of such more preferred mineral oil include liquid paraffin.

Known kinds of silicone compounds may be used as Component B but linear polyorganosiloxanes with viscosity $5\times10^{-3}$-$3\times10^{-1}$ $m^2/s$ at 30° are preferred. Examples thereof include linear polydimethyl siloxane and linear polydimethyl siloxane with modified group. Examples of such modified group include ethyl group, phenyl group, floropropyl group, aminopropyl group, carboxyoctyl group, polyoxyethylene oxypropyl group and ω-methoxypolyethoxy-polypropoxy propyl group. Among these, linear polydimethyl siloxane is preferred.

Known kinds of aliphatic hydroxy compounds may be used as Component B but those with 1-18 carbon atoms are preferred. Examples thereof include methyl alcohol, ethyl alcohol, propyl alcohol, isobutyl alcohol, pentyl alcohol, hexyl alcohol, heptyl alcohol, octyl alcohol, lauryl alcohol, tridecyl alcohol, myristyl alcohol, cetyl alcohol, stearyl alcohol, oleyl alcohol, ethyleneglycol, propyleneglycol, butane diol, hexane diol, neopentylglycol, glycerol, trimethylol propane and pentaerythritol.

Known kinds of lower aliphatic acid and their salts may be used as Component B but lower aliphatic acids with 2-6 carbon atoms and their salts are preferred. Examples thereof include (1) lower aliphatic acids such as acetic acid, butyric acid, gluconic acid, lactic acid, hydroxyacrylic acid, α-oxybutyric acid, glyceric acid, tartoronic acid, malic acid, tartaric acid and citric acid; and (2) salts of lower aliphatic acids such as sodium acetate, sodium butyrate, sodium gluconate, sodium lactate, sodium hydroxyacrylate, sodium α-oxybutyrate, sodium glycerate, sodium tartronate, sodium malate, sodium tartarate and sodium citrate.

When the low concentration (0.1-10 weight %) aqueous solution produced according to a method of this invention contains not only potassium alkyl phosphate which is solid at room temperatures but also Component A and/or B as described above, such Component A and/or B may be added after the potassium alkyl phosphate which is solid at room temperatures has been generated. Of these Components, however, Component A may alternatively be added before the potassium alkyl phosphate which is solid at room temperatures is generated.

The following seven production methods may therefore be presented at examples of method for producing a low concentration (0.1-10 weight %) aqueous solution of this invention containing Component A and/or B in addition to potassium alkyl phosphate which is solid at room temperatures:

Method (1) of gradually adding with stirring acidic alkyl phosphate which is solid at room temperatures in an amount of an aqueous solution containing potassium hydroxide and Component A sufficient to partially neutralize this acidic alkyl phosphate to thereby obtain a low concentration (0.1-10 weight %) aqueous solution of an agent for synthetic fibers containing potassium alkyl phosphate which is solid at room temperatures;

Method (2) of gradually adding with stirring acidic alkyl phosphate which is solid at room temperatures in an amount of an aqueous solution containing potassium hydroxide and Component A sufficient to partially neutralize this acidic alkyl phosphate and thereafter adding Component A further to thereby obtain a low concentration (0.1-10 weight %) aqueous solution of an agent for synthetic fibers containing potassium alkyl phosphate which is solid at room temperatures;

Method (3) of gradually adding with stirring acidic alkyl phosphate which is solid at room temperatures in an amount of an aqueous solution containing potassium hydroxide and Component A sufficient to partially neutralize this acidic alkyl phosphate and thereafter adding Component B further to thereby obtain a low concentration (0.1-10 weight %) aqueous solution of an agent for synthetic fibers containing potassium alkyl phosphate which is solid at room temperatures;

Method (4) of gradually adding with stirring acidic alkyl phosphate which is solid at room temperatures in an amount of an aqueous solution containing potassium hydroxide and Component A sufficient to partially neutralize this acidic alkyl phosphate and thereafter adding Components A and B further to thereby obtain a low concentration (0.1-10 weight %) aqueous solution of an agent for synthetic fibers containing potassium alkyl phosphate which is solid at room temperatures;

Method (5) of gradually adding with stirring acidic alkyl phosphate which is solid at room temperatures in an amount of an aqueous solution containing potassium hydroxide sufficient to partially neutralize this acidic alkyl phosphate and thereafter adding Component A further to thereby obtain a low concentration (0.1-10 weight %) aqueous solution of an agent for synthetic fibers containing potassium alkyl phosphate which is solid at room temperatures;

Method (6) of gradually adding with stirring acidic alkyl phosphate which is solid at room temperatures in an amount of an aqueous solution containing potassium hydroxide sufficient to partially neutralize this acidic alkyl phosphate and thereafter adding Component B further to thereby obtain a low concentration (0.1-10 weight %) aqueous solution of an agent for synthetic fibers containing potassium alkyl phosphate which is solid at room temperatures; and Method (7) of gradually adding with stirring acidic alkyl phosphate which is solid at room temperatures in an amount of an aqueous solution containing potassium hydroxide sufficient to partially neutralize this acidic alkyl phosphate and thereafter adding Components A and B further to thereby obtain a low concentration (0.1-10 weight %) aqueous solution of an agent for synthetic fibers containing potassium alkyl phosphate which is solid at room temperatures.

In these Methods (1)-(7), Component A and/or B may be added directly or by initially preparing an aqueous solution. When Component A and/or B is added, it is preferable to heat the aqueous solution to 30-90° C. and to cool it to 15-25° C. immediately after the addition. If necessary, components other than Component A and/or B such as an anti-oxidant, a preservative and an anti-rusting component may be added in addition to Component A and/or B.

Next, the low concentration aqueous solution of this invention is explained more in detail. The low concentration (0.1-10 weight %) aqueous solution of this invention is what is obtained by a method of this method as explained above and hence is a low concentration (0.1-10 weight %) aqueous solution for synthetic fibers containing an agent for processing synthetic fibers comprising potassium alkyl phosphate which is solid at room temperatures and may additionally contain Component A and/or B as described above.

In the low concentration aqueous solution according to this invention, the concentration of the agent for processing synthetic fibers is 0.1-10 weight %. Agents for processing synthetic fibers containing 20-100 weight parts of potassium alkyl phosphate which is solid at room temperatures and a total of 0-80 weight parts of Component A and/or B per 100 weight parts are preferred. Those containing 55-85 weight parts of potassium alkyl phosphate which is solid at room temperatures and a total of 15-45 weight parts of Component A and/or B per 100 weight parts are particularly preferred.

The method of treating synthetic fibers according to this invention is characterized as causing a low concentration aqueous solution of this invention described above to become adhesively attached to the synthetic fibers. This may be carried out during any of the spinning and fabrication steps for synthetic fibers such as the spinning, drawing crimping steps but it is preferable to be done before or after the spinning step or the crimping step. The method of application may be by dipping, by spraying, by using rollers or by a guide oiling method by means of a measuring pump, but methods by dipping and spraying are preferred. The amount to be attached is preferably 0.1-1 weight % and more preferably 0.1-0.5 weight %.

Examples of synthetic fibers to which the method of treatment according to this invention may be applied include (1) polyester fibers with ethylene terephthalate as their main component; (2) polyacryl fibers such as polyacrylonitril and modacryl; and (3) polyolefin fibers such as polyethylene and polypropylene, but good effects are obtained when applied to polyester fibers.

With a method according to this invention, a low concentration aqueous solution of an agent comprising potassium alkyl phosphate for processing synthetic fibers by having it attached to synthetic fibers at the spinning or processing factories can be produced inexpensively and as a product with improved stability by not generating floating objects or sediments for an extended period of time. Thus, synthetic fibers can be provided with desired characteristics if such a low concentration aqueous solution according to this invention produced by such a method is attached to them.

Preferred Embodiments of the Invention

The following Production Methods (1)-(10) may be presented as preferred embodiments of the present invention.

(1) The method of using acidic alkyl phosphate (T-1) which is solid at room temperatures and component (A-1) as Component A and gradually adding 3.1 weight parts of acidic alkyl phosphate (T-1) with stirring into an aqueous solution containing 0.54 weight parts of potassium hydroxide adapted to neutralize 89% of the acid value of this acidic alkyl phosphate (T-1) and 1.5 weight parts of component (A-1) so as to produce a low concentration aqueous solution (5 weight %) of an agent for processing synthetic fibers containing potassium stearyl phosphate which is solid at room temperatures as well as component (A-1), wherein:

acidic alkyl phosphate (T-1) is acidic stearyl phosphate having stearyl group as alkyl group, acid value of 195, degree of phosphation 0.80, and the form of flakes with thickness 0.9 mm; and component (A-1) is a mixture of α-lauryl-ω-hydroxy-poly (n=10)oxyethylene (where n is the repetition number of oxyethylene units) and α-stearyl-ω-hydroxy-poly(n=20)oxyethylene at weight ratio of 50/50.

(2) The method of using acidic alkyl phosphate (T-2) which is solid at room temperatures and component (A-2) as Component A and gradually adding 3.2 weight parts of acidic alkyl phosphate (T-2) with stirring into an aqueous solution containing 0.48 weight parts of potassium hydroxide adapted to neutralize 86% of the acid value of this acidic alkyl phosphate (T-2) and 1.5 weight parts of component (A-2) so as to produce a low concentration aqueous solution (5 weight %) of an agent for processing synthetic fibers containing potassium stearyl phosphate which is solid at room temperatures as well as component (A-2), wherein:

acidic alkyl phosphate (T-2) is acidic stearyl phosphate having stearyl group as alkyl group, acid value of 175, degree of phosphation 0.67, and the form of flakes with thickness 1.2 mm; and component (A-2) is a mixture of α-lauryl-ω-hydroxy-poly (n=10)oxyethylene and α-laurylamino-ω-hydroxy-poly (n=10)oxyethylene at weigh ratio of 50/50.

(3) The method of using acidic alkyl phosphate (T-3) which is solid at room temperatures and component (A-3) as Component A and gradually adding 2.7 weight parts of acidic alkyl phosphate (T-3) with stirring into an aqueous solution containing 0.44 weight parts of potassium hydroxide adapted to neutralize 91% of the acid value of this acidic alkyl phosphate (T-3) and 2.0 weight parts of component (A-3) so as to produce a low concentration aqueous solution (5 weight %) of an agent for processing synthetic fibers containing potassium cetylstearyl phosphate which is solid at room temperatures as well as component (A-3), wherein:

acidic alkyl phosphate (T-3) is acidic cetylstearyl phosphate having both cetyl and stearyl groups at molar ratio of 25/75 as alkyl groups, acid value of 180, degree of phosphation 0.85, and the form of flakes with thickness 1.0 mm; and component (A-3) is α-laurylamino-ω-hydroxy-poly (n=10)oxyethylene.

(4) The method of using acidic alkyl phosphate (T-4) which is solid at room temperatures and component (A-4) as Component A and gradually adding 2.7 weight parts of acidic alkyl phosphate (T-4) with stirring into an aqueous solution containing 0.49 weight parts of potassium hydroxide adapted to neutralize 93% of the acid value of this acidic alkyl phosphate (T-4) and 2.0 weight parts of component (A-4) so as to produce a low concentration aqueous solution (5 weight %) of an agent for processing synthetic fibers containing potassium cetyl phosphate which is solid at room temperatures as well as component (A-4), wherein:

acidic alkyl phosphate (T-4) is acidic cetyl phosphate having cetyl group as alkyl group, acid value of 195, degree of phosphation 0.69, and the form of flakes with thickness 1.0 mm; and component (A-4) is a mixture of α-nonylphenyl-ω-hydroxy-poly(n=10) oxyethylene and α-laurylamino-ω-hydroxy-poly(n=20)oxyethylene at a molar ratio of 50/50.

(5) The method of using aforementioned acidic alkyl phosphate (T-1) which is solid at room temperatures, aforementioned component (A-2) as Component A and component (B-1) as Component B, gradually adding 1.30 weight parts of acidic alkyl phosphate (T-1) with stirring into an aqueous solution containing 0.20 weight parts of potassium hydroxide adapted to neutralize 79% of the acid value of this acidic alkyl phosphate (T-1) and 0.5 weight parts of component (A-2) and thereafter gradually further adding 0.1 weight part of component (B-1) so as to produce a low concentration aqueous solution (2 weight %) of an agent for processing synthetic fibers containing potassium stearyl phosphate which is solid at room temperatures as well as components (A-2) and (B-1), wherein:

component (B-1) is a mixture of α-stearylamide-ω-hydroxy-poly(n=7) oxyethylene, polyoxyethylene polyoxypropylene hydrogenated caster oil ether having polyoxyethylene group with oxyethylene unit repeating number of 10 (or n=10) and polyoxypropylene group with oxypropylene unit repeating number of 10 (or m=10), paraffin wax with melting point at 50° C. and linear polydimethyl siloxane with viscosity $1\times10^{-3}$ $m^2/s$ at 30° C. at weight ratio of 40/40/10/10.

(6) The method of using aforementioned acidic alkyl phosphate (T-2) which is solid at room temperatures, aforementioned component (A-3) and component (A-7) to be described below as Component A and component (B-2) to be described below as Component B, gradually adding 2.7 weight parts of acidic alkyl phosphate (T-2) with stirring into an aqueous solution containing 0.38 weight parts of potassium hydroxide adapted to neutralize 80% of the acid value of this acidic alkyl phosphate (T-2) and 1.5 weight parts of component (A-3) and thereafter gradually further adding 0.3 weight parts of component (A-7) and 0.2 weight parts of component (B-2) so as to produce a low concentration aqueous solution (5 weight %) of an agent for processing synthetic fibers containing potassium stearyl phosphate which is solid at room temperatures as well as components (A-3), (A-7) and (B-2), wherein:

component (A-7) is potassium octyl phosphate; and component (B-2) is a mixture of poly(n=20)oxyethylene sorbitan monostearate, sorbitan monostearate, dimethyloctyl ammonium trimethyl phosphate and stearyl stearate at weight ratio of 40/30/10/20.

(7) The method of using aforementioned acidic alkyl phosphate (T-2) which is solid at room temperatures, aforementioned component (A-4) as Component A and component (B-3) to be described below as Component B, gradually adding 2.7 weight parts of acidic alkyl phosphate (T-2) with stirring into an aqueous solution containing 0.43 weight parts of potassium hydroxide adapted to neutralize 91% of the acid value of this acidic alkyl phosphate (T-2) and 1.75 weight parts of component (A-4) and thereafter gradually further adding 0.25 weight parts of component (B-3) so as to produce a low concentration aqueous solution (5 weight %) of an agent for processing synthetic fibers containing potassium stearyl phosphate which is solid at room temperatures as well as components (A-4) and (B-3), wherein:

component (B-3) is a mixture of polyester having sulfonic acid salt group with average molecular value 6000 obtained by condensation polymerization of propyleneglycol, ethyleneglycol, dimethyl adipate and dimethyl sodium 5-sulfoisophthalate at molar ratio of 30/20/45/5, mineral oil with viscosity of $3\times10^{-6}$ $m^2/s$ at 30° C., oleic acid and potassium acetate at weight ratio of 80/10/5/5.

(8) The method of using aforementioned acidic alkyl phosphate (T-3) which is solid at room temperatures, component (A-S) to be described below as Component A and aforementioned component (B-1) as Component B, gradually adding 3.4 weight parts of acidic alkyl phosphate (T-3) with stirring into an aqueous solution containing 0.49 weight parts of potassium hydroxide adapted to neutralize 80% of the acid value of this acidic alkyl phosphate (T-3) and 1.0 weight part of component (A-S) and thereafter gradually further adding 0.25 weight parts of component (B-1) so as to produce a low concentration aqueous solution (5 weight %) of an agent for processing synthetic fibers containing potassium cetylstearyl phosphate which is solid at room temperatures as well as components (A-S) and (B-1), wherein:

component (A-S) is a mixture of α-oleyl-ω-hydroxy-poly (n=8)oxyethylene and potassium octyl phosphate at a weight ratio of 80/20.

(9) The method of using aforementioned acidic alkyl phosphate (T-4) which is solid at room temperatures and aforementioned component (A-3) and component (A-6) to be described below as Component A, gradually adding 2.3 weight parts of acidic alkyl phosphate (T-4) with stirring into an aqueous solution containing 0.38 weight parts of potassium hydroxide adapted to neutralize 85% of the acid value of this acidic alkyl phosphate (T-4) and 0.6 weight part of component (A-6) and thereafter gradually further adding 0.3 weight parts of component (A-3) so as to produce a low concentration aqueous solution (3 weight %) of an agent for processing synthetic fibers containing potassium cetyl phosphate which is solid at room temperatures as well as components (A-3) and (A-6), wherein:

component (A-6) is α-oleyl-ω-hydroxy-poly(n=8)oxyethylene.

(10) The method of using aforementioned acidic alkyl phosphate (T-4) which is solid at room temperatures, aforementioned components (A-1) and (A-7) as Component A and component (B-4) to be described below as Component B, gradually adding 2.7 weight parts of acidic alkyl phosphate (T-4) with stirring into an aqueous solution containing 0.49 weight parts of potassium hydroxide adapted to neutralize 93% of the acid value of this acidic alkyl phosphate (T-4) and 1.0 weight part of component (A-7) and thereafter gradually further adding 0.70 weight parts of component (A-1) and 0.3 weight parts of component (B-4) so as to produce a low concentration aqueous solution (5 weight %) of an agent for processing synthetic fibers containing potassium cetyl phosphate which is solid at room temperatures as well as components (A-1), (A-7) and (B-4), wherein:

component (B-4) is a mixture of potassium lauryl sulfate, lauryldimethylammoniopropionate, polyethylene glycol with molecular weight 400, castor oil and water at a weight ratio of 55/12/8/5/20.

The following (11) is presented as a preferred example of low concentration aqueous solution of this invention:

(11) The low concentration aqueous solution (2-5 weight %) of an agent for processing synthetic fibers obtained by any of the methods of production according to this invention given as (1)-(10) above.

The following (12) is presented as a preferred example of processing method according to this invention:

(12) The method of processing synthetic fibers comprising the step of causing the low concentration aqueous solution according to this invention to synthetic fibers at a rate of 0.13-0.17 weight % of the synthetic fibers.

EXAMPLES

The invention is described next with reference to examples for showing its structures and effects more in detail but it goes without saying that these examples are not intended to limit the scope of this invention. In what follows, "parts" will mean "weight parts" and "%" will mean "weight %" unless otherwise described.

Part 1 (Preparation of Acidic Alkyl Phosphates)

Preparation of Acidic Alkyl Phosphate (T-1)

Stearyl alcohol (789 parts) was placed in a reactor and while it was maintained at 75° C., phosphoric anhydride (165 parts) was gradually added with stirring over a period of 90 minutes for causing a reaction. The reaction was further continued for 3 hours at 80° C. to obtain 954 parts of acidic alkyl phosphate. It was analyzed and found to have acid value 195 and degree of phosphation 0.80. This acidic alkyl phosphate was maintained at 80° C. and acidic alkyl phosphate (T-1) in the form of flakes with thickness 0.9 mm was obtained by means of DRUMCOOLER (product of Mitsubishi Chemical Engineering Corporation).

Preparation of Acidic Alkyl Phosphates (T-2)-(T-9)

As done for the preparation of acidic alkyl phosphate (T-1), acidic alkyl phosphates (T-2)-(T-9) were prepared except that acidic alkyl phosphates (T-5) and (T-6) were made into a powder form by means of SPRAY COOLER (product of Powdering Japan Co., 15 Ltd.) and acidic alkyl phosphates (T-7)-(T-9) were made into a powder form by means of DRYMASTER (product of Hosokawamicron Corporation). Details of these acidic alkyl phosphates are summarized in Table 1.

TABLE 1

| Kind | Form | Thickness or particle diameter | Alkyl group | Acid value | Degree of phosphation |
|---|---|---|---|---|---|
| T-1 | Flakes | 0.9 mm thick | stearyl | 195 | 0.80 |
| T-2 | Flakes | 1.2 mm thick | stearyl | 175 | 0.67 |
| T-3 | Flakes | 1.0 mm thick | cetyl/stearyl = 25/75 molar ratio | 180 | 0.85 |
| T-4 | Flakes | 1.0 mm thick | cetyl | 195 | 0.69 |
| T-5 | Powder | 0.5 mm or less | stearyl | 175 | 0.67 |
| T-6 | Powder | 0.6 mm or less | cetyl | 190 | 0.68 |
| T-7 | Powder | 0.1 mm or less | cetyl | 165 | 0.85 |

TABLE 1-continued

| Kind | Form | Thickness or particle diameter | Alkyl group | Acid value | Degree of phosphation |
|---|---|---|---|---|---|
| T-8 | Powder | 0.1 mm or less | behenyl | 140 | 0.9 |
| T-9 | Powder | 0.1 mm or less | lauryl/behenyl = 50/50 molar ratio | 250 | 1.0 |

Part 2 (Preparation of Low Concentration Aqueous Solutions of Agents for Processing Synthetic Fibers)

Test Example 1

Preparation of Low Concentration Aqueous Solution (P-1)

Potassium hydroxide (0.54 parts), component (A-1) (mixture of α-lauryl-ω-hydroxy-poly(n=10)oxyethylene and α-stearyl-ω-hydroxy-poly(n=20)oxyethylene at weight ratio of 50/50) (1.5 parts) and water (94.86 parts) were placed in a screw-type stirrer with vanes and stirred together with the rotary speed of the vanes at 550 rpm while the mixture was heated to 60° C. While the heated aqueous solution containing potassium hydroxide and component (A-1) was stirred at this rotary speed, acidic alkyl phosphate (T-1) prepared in Part 1 (3.1 parts) was gradually added and the stirring was continued further for 10 minutes after the addition. In the meantime, the temperature of the aqueous solution inside the reactor was maintained at 60-80° C. Thereafter, it was cooled to 30° C. to obtain 5% low concentration aqueous solution (P-1) of agent for processing synthetic fibers.

Test Examples 2-4 and 25-28

Preparation of Low Concentration Aqueous Solutions (P-2)-(P-4) and (P-25)-(P-28)

Low concentration aqueous solutions (P-2)-(P-4) and (P-25)-(P-28) of Test Examples 2-4 and 25-28 were obtained as low concentration aqueous solution (P-1) of agent for processing synthetic fibers was prepared in Test Example 1.

Test Example 5

Preparation of Low Concentration Aqueous Solution (P-5)

Potassium hydroxide (0.2 parts), component (A-2) (mixture of α-lauryl-ω-hydroxy-poly(n=10)oxyethylene and α-laurylamino-ω-hydroxy-poly(n=10)oxyethylene at weight ratio of 50/50) (0.5 parts) and water (97.9 parts) were placed in a screw-type stirrer with vanes and stirred together with the rotary speed of the vanes at 550 rpm while the mixture was heated to 60° C. While the heated aqueous solution containing potassium hydroxide and component (A-2) was stirred at this rotary speed, acidic alkyl phosphate (T-1) prepared in Part 1 (1.30 parts) was gradually added and the stirring was continued further for 10 minutes after the addition. In the meantime, the temperature of the aqueous solution inside the reactor was maintained at 60-80° C. Next, while the stirring was still continued at the same rotary speed, aforementioned component (B-1) (0.1 part) was added. Thereafter, it was further stirred for 10 minutes at the same rate and then cooled to 30° C. while the stirring was continued to obtain 2% low concentration aqueous solution (P-5) of agent for processing synthetic fibers.

Test Examples 6-15

Preparation of Low Concentration Aqueous Solutions (P-6)-(P-15)

Low concentration aqueous solutions (P-6)-(P-15) of Test Examples 6-15 were obtained as low concentration aqueous solution (P-5) of agent for processing synthetic fibers was prepared in Test Example 5.

Test Example 16

Preparation of Low Concentration Aqueous Solution (P-16)

Potassium hydroxide (0.54 parts) and water (94.86 parts) were placed in a screw-type stirrer with vanes and stirred together with the rotary speed of the vanes at 550 rpm while the mixture was heated to 60° C. While the heated aqueous solution containing potassium hydroxide was stirred at this rotary speed, acidic alkyl phosphate (T-1) prepared in Part 1 (3.1 parts) was gradually added and the stirring was continued further for 10 minutes after the addition. In the meantime, the temperature of the aqueous solution inside the reactor was maintained at 60-80° C. Next, while the stirring was still continued at the same rotary speed, aforementioned component (A-2) (1.5 parts) was added. Thereafter, it was further stirred for 10 minutes at the same rate and then cooled to 30° C. while the stirring was continued to obtain 5% low concentration aqueous solution (P-16) of agent for processing synthetic fibers.

Test Examples 17-24

Preparation of Low Concentration Aqueous Solutions (P-17)-(P-24)

Low concentration aqueous solutions (P-17)-(P-24) of Test Examples 17-24 were obtained as low concentration aqueous solution (P-16) agent for processing synthetic fibers was prepared in Test Example 16.

Details of these low concentration aqueous solutions of Test Examples thus prepared are summarized in Table 2.

TABLE 2

| | Acidic alkyl phosphate Kind/Part | Potassium hydroxide Part/*1 | Component A*4 Kind/Part | Water Part | Component A and/or B*5 Kind/Part | Low concentration aqueous solution *2/*3/Kind |
|---|---|---|---|---|---|---|
| Test Examples | | | | | | |
| 1 | T-1/3.1 | 0.54/89 | A-1/1.5 | 94.86 | | 5/70/P-1 |
| 2 | T-2/3.2 | 0.48/86 | A-2/1.5 | 94.82 | | 5/70/P-2 |
| 3 | T-3/2.7 | 0.44/91 | A-3/2.0 | 94.86 | | 5/60/P-3 |
| 4 | T-4/2.7 | 0.49/93 | A-4/2.0 | 94.81 | | 5/60/P-4 |
| 5 | T-1/1.3 | 0.20/79 | A-2/0.5 | 97.90 | B-1/0.1 | 2/70/P-5 |
| 6 | T-2/2.7 | 0.38/80 | A-3/1.5 | 94.92 | A-7/0.3<br>B-2/0.2 | 5/60/P-6 |
| 7 | T-2/2.7 | 0.43/91 | A-4/1.75 | 94.87 | B-3/0.25 | 5/60/P-7 |
| 8 | T-3/3.4 | 0.49/80 | A-5/1.0 | 94.86 | B-1/0.25 | 5/75/P-8 |
| 9 | T-4/2.3 | 0.38/85 | A-6/0.6 | 96.42 | A-3/0.3 | 3/70/P-9 |
| 10 | T-4/2.7 | 0.49/93 | A-7/1.0 | 94.81 | A-1/0.7<br>B-4/0.3 | 5/60/P-10 |
| 11 | T-5/4.3 | 0.71/94 | A-5/0.9 | 93.79 | B-3/0.3 | 6/80/P-11 |
| 12 | T-5/5.0 | 0.86/98 | A-8/2.0 | 91.74 | A-4/0.2<br>B-2/0.2 | 8/70/P-12 |
| 13 | T-5/7.5 | 0.98/75 | A-9/0.5 | 90.52 | B-4/0.5 | 9/90/P-13 |
| 14 | T-6/3.8 | 0.54/75 | A-10/4.0 | 90.71 | B-1/0.95 | 9/45/P-14 |
| 15 | T-6/3.6 | 0.51/75 | A-11/3.2 | 91.89 | A-8/0.8 | 8/50/P-15 |
| Reference Examples | | | | | | |
| 16 | T-1/3.1 | 0.54/90 | | 94.86 | A-2/1.5 | 5/70/P-16 |
| 17 | T-2/1.6 | 0.26/93 | | 96.94 | A-2/1.2 | 3/60/P-17 |
| 18 | T-3/4.3 | 0.66/85 | | 93.84 | A-2/1.2 | 6/80/P-18 |
| 19 | T-4/1.1 | 0.17/79 | | 97.93 | A-2/0.8 | 2/60/P-19 |
| 20 | T-5/3.4 | 0.58/97 | | 94.77 | A-2/1.25 | 5/75/P-20 |
| 21 | T-6/6.6 | 0.94/75 | | 91.66 | A-2/0.8 | 8/90/P-21 |
| 22 | T-7/4.4 | 0.65/90 | | 93.75 | A-2/1.2 | 6/80/P-22 |
| 23 | T-8/0.8 | 0.08/71 | | 99.02 | A-1/0.1 | 1/90/P-23 |
| 24 | T-9/0.4 | 0.08/80 | | 99.02 | A-3/0.5 | 1/50/P-24 |

TABLE 2-continued

| | Acidic alkyl phosphate Kind/Part | Potassium hydroxide Part/*1 | Component A*4 Kind/Part | Water Part | Component A and/or B*5 Kind/Part | Low concentration aqueous solution *2/*3/Kind |
|---|---|---|---|---|---|---|
| 25 | T-1/8.0 | 1.51/97 | | 90.49 | | 9/100/P-25 |
| 26 | T-2/8.1 | 1.37/97 | | 90.53 | | 9/100/P-26 |
| 27 | T-3/8.0 | 1.41/98 | | 90.59 | | 9/100/P-27 |
| 28 | T-4/8.0 | 1.53/98 | | 90.47 | | 9/100/P-28 |

In Table 2:
*1Ratio (%) of partial neutralization of acid value of acidic alkyl phosphate by potassium hydroxide;
*2Concentration (%) of agent for processing synthetic fibers in low concentration aqueous solution;
*3Ratio (%) of potassium alkyl phosphate in agent for processing synthetic fibers in low concentration aqueous solution;
*4Component A added before partial neutralization;
*5Component A and/or B added after partial neutralization;
"Part": Weight part that was used;
A-1: Mixture of α-lauryl-ω-hydroxy-poly(n = 10)oxyethylene and α-stearyl-ω-hydroxy-poly(n = 20)oxyethylene at weight ratio of 50/50;
A-2: Mixture of α-lauryl-ω-hydroxy-poly(n = 10)oxyethylene and α-laurylamino-ω-hydroxy-poly(n = 10)oxyethylene at weight ratio of 50/50;
A-3: α-laurylamino-ω-hydroxy-poly(n = 10)oxyethylene;
A-4: Mixture of α-nonylphenyl-ω-hydroxy-poly(n = 10)oxyethylene and α-laurylamino-ω-hydroxy-poly(n = 10)oxyethylene at weight ratio of 50/50;
A-5: Mixture of α-oleyl-ω-hydroxy-poly(n = 8)oxyethylene and potassium octyl phosphate at weight ratio of 80/20;
A-6: α-oleyl-ω-hydroxy-poly(n = 8)oxyethylene;
A-7: Potassium octyl phosphate;
A-8: Sodium tetradecene sulfonate;
A-9: Potassium laurate;
A-10: Potassium oleyl phosphate;
A-11: Potassium α-lauryl-ω-hydroxy-poly(n = 8)oxyethylene phosphate;
B-1: Mixture of α-stearylamide-ω-hydroxy-poly(n = 7) oxyethylene, polyoxyethylene polyoxypropylene hydrogenated caster oil ether having polyoxyethylene group with oxyethylene unit repeating number of 10 and polyoxypropylene group with oxypropylene unit repeating number of 10, paraffin wax with melting point at 50° C. and linear polydimethyl siloxane with viscosity $1 \times 10^{-3} m^2/s$ at 30° C. at weight ratio of 40/40/10/10;
B-2: Mixture of poly(n = 20)oxyethylene sorbitan monostearate, sorbitan monostearate, dimethyloctyl ammonium trimethyl phosphate and stearyl stearate at weight ratio of 40/30/10/20;
B-3: Mixture of polyester having sulfonic acid salt group with average molecular value 6000 obtained by condensation polymerization of propyleneglycol, ethyleneglycol, dimethyl adipate and dimethyl sodium 5-sulfoisophthalate at molar ratio of 30/20/45/5, mineral oil with viscosity of $3 \times 10^{-6} m^2/s$ at 30° C., oleic acid and potassium acetate at weight ratio of 80/10/5/5;
B-4: Mixture of potassium lauryl sulfate, lauryldimethylammonioproprianate, polyethylene glycol with molecular weight 400, castor oil and water at a weight ratio of 55/12/8/5/20.

Comparison Example 1

Preparation of Low Concentration Aqueous Solution (r-1)

An aqueous solution (82.1 parts) containing potassium hydroxide (3.1 parts) was placed in a screw-type stirrer with vanes and stirred with the rotary speed of the vanes at 550 rpm while it was heated to 60° C. While the heated aqueous solution containing potassium hydroxide was stirred at this rotary speed, acidic alkyl phosphate (T-1) prepared in Part 1 (17.9 parts) was gradually added and the stirring was continued further for 10 minutes after the addition. In the meantime, the temperature of the aqueous solution inside the reactor was maintained at 60-80° C. Thereafter, it was cooled to 30° C. to prepare a 20% high concentration aqueous solution (R-1) of agent for processing synthetic fibers. After this 20% high concentration aqueous solution (R-1) was stored for 30 days alternately every 24 hours in heat reservoirs at temperatures of 20° C. and 70° C., it was added to 300 parts of warm water at 60° C. to obtain 5% low concentration aqueous solution (r-1) of agent for processing synthetic fibers.

Comparison Example 2

Preparation of Low Concentration Aqueous Solution (r-2)

Potassium hydroxide (2.2 parts), aforementioned component (A-1) (6 parts) and water (79.3 parts) were placed in a screw-type stirrer with vanes and stirred with the rotary speed of the vanes at 550 rpm while it was heated to 60° C. While the heated aqueous solution containing potassium hydroxide and component (A-1) was stirred at this rotary speed, acidic alkyl phosphate (T-1) prepared in Part 1 (12.5 parts) was gradually added and the stirring was continued further for 10 minutes after the addition. In the meantime, the temperature of the aqueous solution inside the reactor was maintained at 60-80° C. Thereafter, it was cooled to 30° C. to prepare a 20% high concentration aqueous solution (R-2) of agent for processing synthetic fibers. After this 20% high concentration aqueous solution (R-2) was stored for 30 days alternately every 24 hours in heat reservoirs at temperatures of 20° C. and 70° C., it was added to 300 parts of warm water at 60° C. to obtain 5% low concentration aqueous solution (r-2) of agent for processing synthetic fibers.

Comparison Example 3

Preparation of Low Concentration Aqueous Solution (r-3)

An aqueous solution (64.2 parts) containing potassium hydroxide (6.2 parts) was placed in a screw-type stirrer with vanes and stirred with the rotary speed of the vanes at 550 rpm while it was heated to 60° C. While the heated aqueous solution containing potassium hydroxide was stirred at this rotary speed, acidic alkyl phosphate (T-1) prepared in Part 1 (35.8 parts) was gradually added and the stirring was continued further for 10 minutes after the addition. In the meantime, the temperature of the aqueous solution inside the reactor was maintained at 60-80° C. Thereafter, it was cooled to 30° C. to prepare a 40% high concentration aqueous solution (R-3) of agent for processing synthetic fibers. After this 40% high concentration aqueous solution (R-3) was stored for 30 days alternately every 24 hours in heat reservoirs at temperatures of 20° C. and 70° C., it was added to 700 parts of warm water at 60° C. to obtain 5% low concentration aqueous solution (r-3) of agent for processing synthetic fibers.

Comparison Example 4

Preparation of Low Concentration Aqueous Solution (r-4)

Potassium hydroxide (4.4 parts), aforementioned component (A-1) (12 parts) and water (58.6 parts) were placed in a screw-type stirrer with vanes and stirred with the rotary speed of the vanes at 550 rpm while it was heated to 60° C. While the heated aqueous solution containing potassium hydroxide and component (A-1) was stirred at this rotary speed, acidic alkyl phosphate (T-1) prepared in Part 1 (25 parts) was gradually added and the stirring was continued further for 10 minutes after the addition. In the meantime, the temperature of the aqueous solution inside the reactor was maintained at 60-80° C. Thereafter, it was cooled to 30° C. to prepare a 40% high concentration aqueous solution (R-4) of agent for processing synthetic fibers. After this 40% high concentration aqueous solution (R-4) was stored for 30 days alternately every 24 hours in heat reservoirs at temperatures of 20° C. and 70° C., it was added to 700 parts of warm water at 60° C. to obtain 5% low concentration aqueous solution (r-4) of agent for processing synthetic fibers.

Comparison Example 5

Preparation of Low Concentration Aqueous Solution (r-5)

An aqueous solution (46.3 parts) containing potassium hydroxide (9.3 parts) was placed in a screw-type stirrer with vanes and stirred with the rotary speed of the vanes at 550 rpm while it was heated to 60° C. While the heated aqueous solution containing potassium hydroxide was stirred at this rotary speed, acidic alkyl phosphate (T-1) prepared in Part 1 (53.7 parts) was gradually added and the stirring was continued further for 10 minutes after the addition. In the meantime, the temperature of the aqueous solution inside the reactor was maintained at 60-80° C. Thereafter, it was cooled to 30° C. to prepare a 60% high concentration aqueous solution (R-5) of agent for processing synthetic fibers. After this 60% high concentration aqueous solution (R-5) was stored for 30 days alternately every 24 hours in heat reservoirs at temperatures of 20° C. and 70° C., it was added to 1100 parts of warm water at 60° C. to obtain 5% low concentration aqueous solution (r-5) of agent for processing synthetic fibers.

Comparison Example 6

Preparation of Low Concentration Aqueous Solution (r-6)

Potassium hydroxide (6.6 parts), aforementioned component (A-1) (18 parts) and water (37.9 parts) were placed in a screw-type stirrer with vanes and stirred with the rotary speed of the vanes at 550 rpm while it was heated to 60° C. While the heated aqueous solution containing potassium hydroxide and component (A-1) was stirred at this rotary speed, acidic alkyl phosphate (T-1) prepared in Part 1 (37.5 parts) was gradually added and the stirring was continued further for 10 minutes after the addition. In the meantime, the temperature of the aqueous solution inside the reactor was maintained at 60-80° C. Thereafter, it was cooled to 30° C. to prepare a 60% high concentration aqueous solution (R-6) of agent for processing synthetic fibers. After this 60% high concentration aqueous solution (R-6) was stored for 30 days alternately every 24 hours in heat reservoirs at temperatures of 20° C. and 70° C., it was added to 1100 parts of warm water at 60° C. to obtain 5% low concentration aqueous solution (r-6) of agent for processing synthetic fibers.

Part 3 (Evaluation of Low Concentration Aqueous Solutions of Agent for Treatment of Synthetic Fibers)

Stability of the low concentration aqueous solutions ((P-1)-(P-28) and (r-1)-(r-6)) of agent for treatment of synthetic fibers prepared in Part 2 was evaluated by the following three evaluation methods. The results are summarized in Table 3.

Evaluation Method 1

After each low concentration aqueous solution was left for 7 days at 50° C., it was visually inspected. It was also diluted to concentration of 1% with ion exchange water and adjusted to 25° C. and its transmissivity was measured at 750 nm by means of a spectrophotometer (Ultraviolet-visible spectrometer U-2000 produced by Hitachi, Ltd.) The results were evaluated as follows:

A: Stable with no difference from the time of preparation

B: Stable with no difference from the time of preparation but there is a drop in transmissivity by less than 5%

C: Generation of small amounts of sediments and floating objects and there is a drop in transmissivity by 5-20%

D: Clear generation of sediments and floating objects and there is a drop in transmissivity by greater than 20%.

Evaluation Method 2

After each low concentration aqueous solution was left for 12 hours at 20° C. and further for 12 hours at 70° C. and was subjected to this routine repeatedly for a total of 120 hours, its stability was evaluated as done by Evaluation method 1.

Evaluation Method 3

After each low concentration aqueous solution was stirred in a homomixer at 2000 rpm for 5 days at 50° C., its stability was evaluated as done by Evaluation method 1.

Part 4 (Attachment to Polyester Staple Fibers and its Evaluation)

Attachment to Polyester Staple Fibers

The low concentration aqueous solutions ((P-1)-(P-28) and (r-1)-(r-6)) obtained in Part 2 were left for 7 days at 50° C. and were each applied by spraying to semi-dull polyester staple fibers with fineness $1.3\times10^{-4}$ g/m (1.2 denier) and length 38 mm obtained during the draft making process such that the attached amount would be as shown in Table 3. After it was dried for two hours by a hot air drier at 80° C., humidity was adjusted overnight under the condition of 30° C.×70% RH to obtain processed polyester staple fibers with a processing agent attached thereto. In Table 3, "Attached Amount" indicates the amount of each agent attached to polyester stable fibers.

Evaluation of web uniformity during carding process

The processed polyester staple fibers (10 kg) obtained as described above were subjected to a flat type card engine (product of Howa Machinery, Ltd.) under the condition of 30° C.×70% RH and passed at the delivery speed of 140 m/minute. Uniformity of the delivered carding web was evaluated as follows:

A: No specks at all and uniform

B: A few specks but no problem

C: Some specks and somewhat problematic

D: Many specks observable and problematic.

The result of evaluation is shown in Table 3.

TABLE 3

| | Kind of solution | Stability Method 1 | Stability Method 2 | Stability Method 3 | Attached amount (%) | Web uniformity |
|---|---|---|---|---|---|---|
| Test Examples | | | | | | |
| 29 | P-1 | A | A | A | 0.15 | A |
| 30 | P-2 | A | A | A | 0.15 | A |
| 31 | P-3 | A | A | A | 0.15 | A |
| 32 | P-4 | A | A | A | 0.15 | A |
| 33 | P-5 | A | A | A | 0.17 | A |
| 34 | P-6 | A | A | A | 0.17 | A |
| 35 | P-7 | A | A | A | 0.13 | A |
| 36 | P-8 | A | A | A | 0.13 | A |
| 37 | P-9 | A | A | A | 0.15 | A |
| 38 | P-10 | A | A | A | 0.15 | A |
| 39 | P-11 | A | A–B | A–B | 0.15 | A–B |
| 40 | P-12 | A | A–B | A–B | 0.17 | A–B |
| 41 | P-13 | A | A–B | A–B | 0.14 | A–B |
| 42 | P-14 | A | A–B | B | 0.11 | A–B |
| 43 | P-15 | A | B | A–B | 0.12 | A–B |
| Reference examples | | | | | | |
| 44 | P-16 | A–B | B | B | 0.15 | B |
| 45 | P-17 | A–B | B | B | 0.15 | B |
| 46 | P-18 | A–B | B | B | 0.13 | B |
| 47 | P-19 | A–B | B | B | 0.17 | B |
| 48 | P-20 | B | B | B | 0.17 | B |
| 49 | P-21 | B | B | B | 0.17 | B |
| 50 | P-22 | B | B | B | 0.15 | B |
| 51 | P-23 | B | B | B | 0.17 | B |
| 52 | P-24 | B | B | B | 0.17 | B |
| 53 | P-25 | B | B | B | 0.17 | B |
| 54 | P-26 | B | B | B | 0.17 | B |
| 55 | P-27 | B | B | B | 0.17 | B |
| 56 | P-28 | B | B | B | 0.17 | B |
| Comparison Examples | | | | | | |
| 1 | r-1 | D | D | D | 0.15 | D |
| 2 | r-2 | C | D | D | 0.16 | D |
| 3 | r-3 | D | D | D | 0.15 | D |
| 4 | r-4 | C | D | D | 0.16 | D |
| 5 | r-5 | D | D | D | 0.16 | D |
| 6 | r-6 | D | D | D | 0.16 | D |

In Table 3:

Attached amount (%): Attached amount (%) as agent for treatment of synthetic fibers with respect to polyester stable fibers.

What is claimed is:

1. A method of producing a low concentration aqueous solution of agent for processing synthetic fibers, said method comprising the steps of:

preparing acidic alkyl phosphate which is solid at room temperatures; and gradually adding said prepared acidic alkyl phosphate with stirring to an aqueous solution containing potassium hydroxide and Component A in an amount sufficient to partially neutralize said acidic alkyl phosphate, said Component A consisting of one or more selected from the group consisting of alkylene oxide adducts of aliphatic monohydric alcohol, alkylene oxide adducts of substituted aromatic monohydric alcohol, alkylene oxide adducts of aliphatic amine, organic sulfonates, higher fatty acid salts, salts of acidic alkyl phosphates which are liquid at room temperatures, alkenyl phosphate salts, alkyl(poly)oxyalkylene phosphate salts and alkenyl(poly)oxyalkylene phosphate salts, thereby obtaining 0.1-10 weight % low concentration aqueous solution of agent for processing synthetic fibers containing potassium alkyl phosphate which is solid at room temperatures and said Component A.

2. The method of claim 1 wherein said acidic alkyl phosphate which is solid at room temperatures has alkyl group with 16-18 carbon atoms.

3. The method of claim 2 wherein said acidic alkyl phosphate which is solid at room temperatures has acid value 100-300 and degree of phosphation 0.6-1.

4. The method of claim 3 wherein said aqueous solution containing potassium hydroxide is added in an amount for neutralizing 70-99% of the acid value of said acidic alkyl phosphate.

5. The method of claim 4 wherein said acidic alkyl phosphate is in a form of flakes.

6. The method of claim 1 wherein said 0.1-10 weight % low concentration aqueous solution is obtained by further adding at least one component selected from the group consisting of Component A and Component B after said prepared acidic alkyl phosphate is gradually added with stirring to said aqueous solution containing potassium hydroxide and said Component A, wherein Component B consists of one or more selected from the group consisting of alkylene oxide addusts of aliphatic amide, ester of polyoxyalkylene polyhydric alcohol and fatty acids, alkylene oxide adducts of aliphatic acid, aliphatic partial esters of polyhydric alcohol, organic sulfuric acid salts, amphoteric surfactants, cationic surfactants, synthetic ester compounds, polyether compounds, polyether (poly)ester compounds, vegetable oils, animal oils, waxes, mineral oils, silicone compounds, aliphatic hydroxy compounds, lower aliphatic acids and salts of lower aliphatic acid.

7. The method of claim 6 wherein said acidic alkyl phosphate which is solid at room temperatures has alkyl group with 16-18 carbon atoms.

8. The method of claim 7 wherein said acidic alkyl phosphate which is solid at room temperatures has acid value 100-300 and degree of phosphation 0.6-1.

9. The method of claim 8 wherein said aqueous solution containing potassium hydroxide is added in an amount for neutralizing 70-99% of the acid value of said acidic alkyl phosphate.

10. The method of claim 9 wherein said acidic alkyl phosphate is in a form of flakes.

* * * * *